United States Patent [19]

Schlemmer

[11] 4,099,328

[45] Jul. 11, 1978

[54] MACHINE FOR REMOVING FLOOR COVERING

[76] Inventor: John E. Schlemmer, 104 Southview Dr., Grundy Center, Iowa 50638

[21] Appl. No.: 817,208

[22] Filed: Jul. 20, 1977

[51] Int. Cl.[2] ..... A47L 11/02; B24B 55/06

[52] U.S. Cl. ..... 30/172; 15/49 R; 51/177

[58] Field of Search ..... 15/49 R; 51/177; 30/172, 121

[56] References Cited

U.S. PATENT DOCUMENTS

| | | | |
|---|---|---|---|
| 1,951,105 | 3/1934 | Myers | 15/49 R |
| 1,958,658 | 5/1934 | Engberg | 15/49 R |
| 2,626,412 | 1/1953 | Petersen | 51/177 X |
| 3,010,135 | 11/1961 | Pollnow | 15/49 R |
| 3,303,524 | 2/1967 | Schneider | 15/49 R |
| 3,452,380 | 7/1969 | Walther | 15/49 R |
| 3,858,367 | 1/1975 | Whitsett | 30/172 X |

*Primary Examiner*—Jimmy C. Peters
*Attorney, Agent, or Firm*—Rudolph L. Lowell

[57] ABSTRACT

A machine for shredding and removing a resilient covering material from a floor surface has a portable base structure defining an open bottomed shredding chamber and a motor unit adjustably supported on the base structure for rotating a wire brush within the shredding chamber. The brush is adjustable to a desired elevated and inclined position relative to the floor surface to facilitate the shredding action and removal of the covering material from the machine. The base structure is supported on thin disk shaped wheels adapted for penetrating the covering material substantially to the level of the floor surface.

10 Claims, 6 Drawing Figures

MACHINE FOR REMOVING FLOOR COVERING

SUMMARY OF THE INVENTION

The machine for shredding and removing covering material from a floor surface is of a rugged and compact construction and adapted for a quick and easy one man operation. The rotatable wire brush effectively strips the covering material from the surface, while moving over nails and like projections without damage. The generally flat working surface of the wire brush is adjustably inclined relative to the floor surface with its trailing edge in contact engagement with the floor and its leading edge spaced from the floor surface a distance approximately equal to the thickness of the covering material being removed. The resultant progressive removal of the covering material not only reduces the power requirements for the machine, but eliminates any tendency of the machine to "free wheel" out of a directed path of movement. The thin disk shaped wheels of the portable base structure are adapted to penetrate the resilient covering material substantially to the level of the floor surface to facilitate positioning of the wire brush. Since the wheels are carried within the confines of the base structure and the machine is of a weight to be manually lifted for movement to a selected working area, the machine is readily manipulated for operation on stairs, along edges and into corners without damage to the adjacent wall surfaces.

The three-post universal tilting mechanism, which adjustably supports the wire brush and motor as a unit assembly on the base structure, provides for a fine adjustment of both the height and inclination of the wire brush relative to the floor surface. The brush may thus be inclined in any direction and varying degree, and vertically adjusted for brush action and/or wear. The compression springs of the tilting mechanism function as a locking means to retain the brush in its adjusted position. The machine of the invention is particularly suitable for removing foam rubber carpet backing and also finds application for removing tile, linoleum, roofing and any other covering material for which the shredding method of removal is effective.

DETAILED DESCRIPTION OF THE INVENTION

Figure 1:
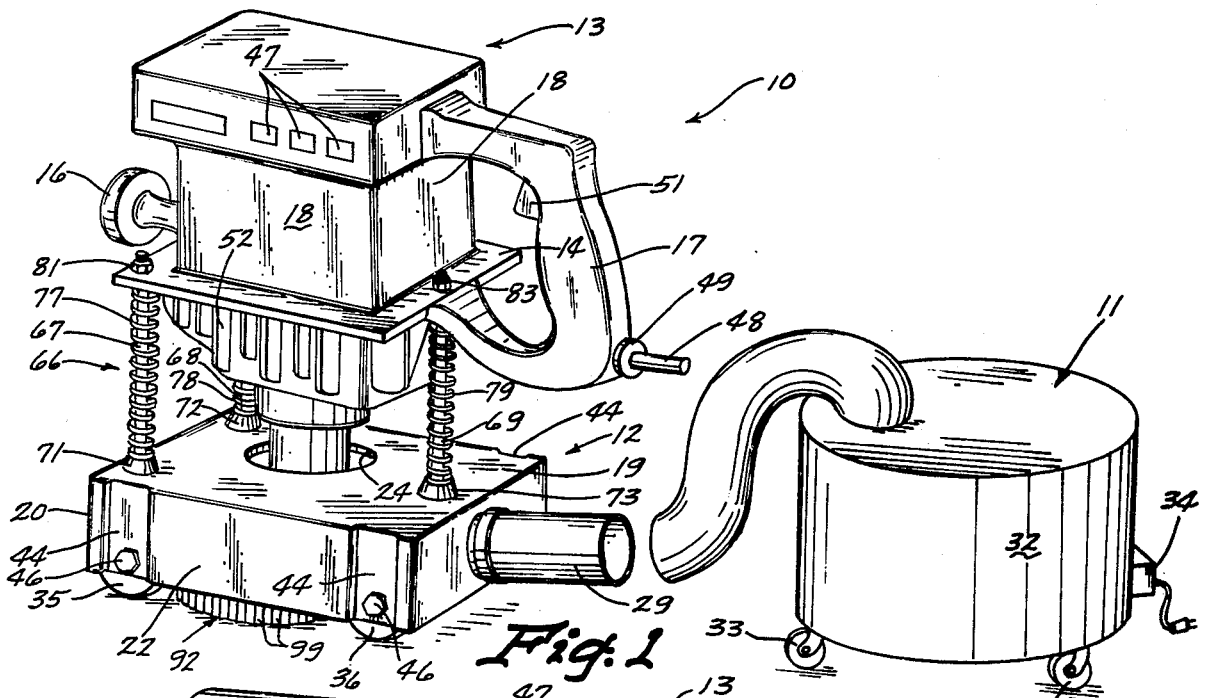
FIG. 1 is a perspective view of the machine in assembly relation with a vacuum unit for removing materials shredded by the machine.

The machine for shredding and removing covering material from a floor surface is indicated at 10 in FIG. 1, in assembly relation with a vacuum unit 11. The machine 10 includes a portable base structure 12 on which an upper frame 13 is adjustably supported. The upper frame includes a flat mounting plate 14 of a generally square shape, front and rear handles 16 and 17, respectively, for controlling and guiding the movement of the machine 10 along a floor surface and a housing 18 for an electrical motor (not shown). The motor has a downwardly projected drive shaft 15 (FIG. 2) for rotating a cutting element 25, shown as a wire brush, within the base structure.

Figure 2:
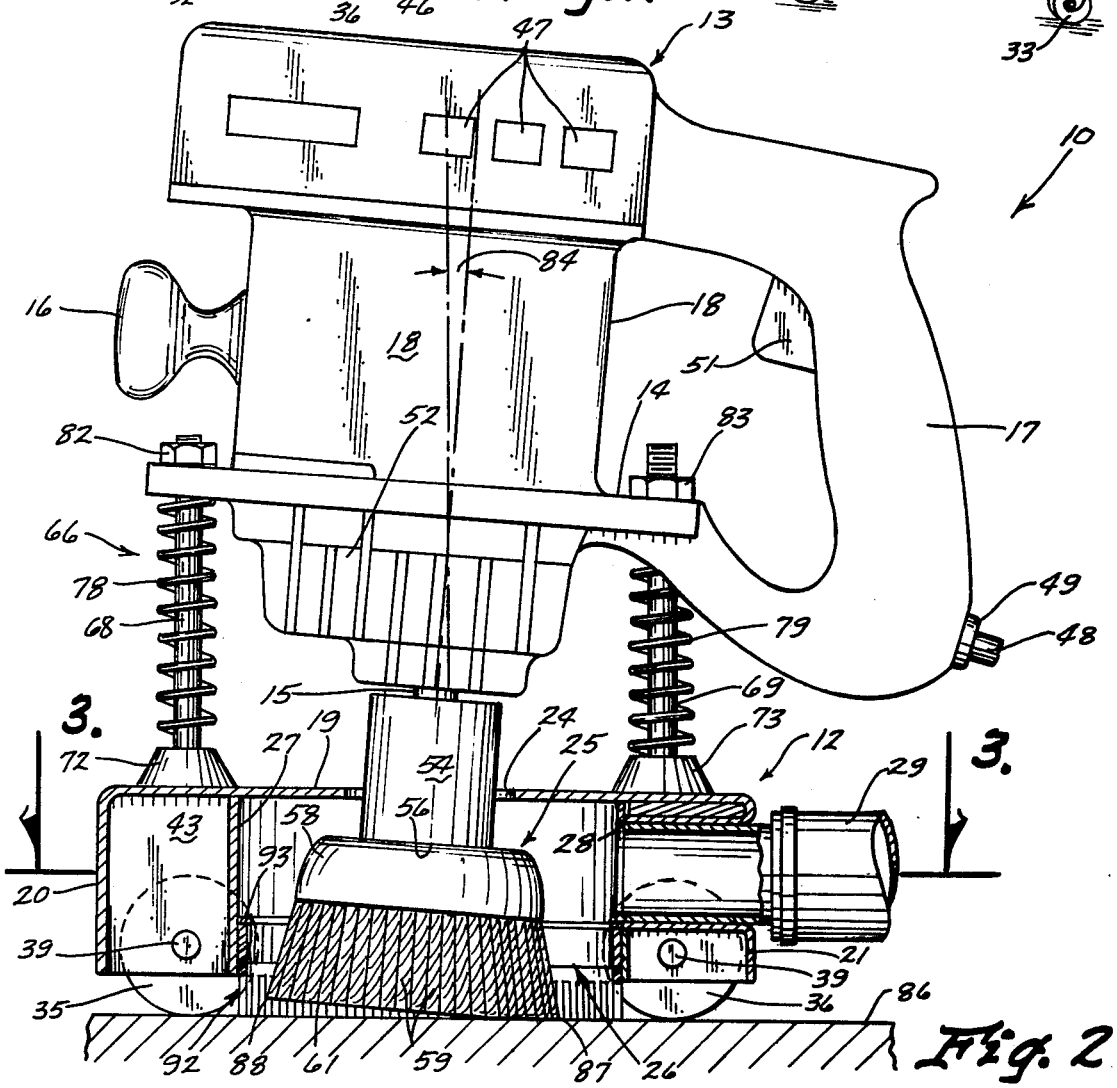
FIG. 2 is an enlarged side view of the machine with the base portion thereof broken away and shown in section for clarity.

The portable base structure 12, FIGS. 1 and 2, includes a top wall 19, front and rear walls 20 and 21, respectively, and opposite side walls 22 and 23. Generally centered on the top wall 19 is a circular opening 24 for access to an open bottomed shredding chamber 26 defined by an annular depending flange 27 on the underside of the top wall 19 concentric with the opening 24. A material discharge outlet 28 on the rear section of the flange 27 is connectible with a suction hose 29 of the vacuum unit 11 which is shown in FIG. 1 as a shop type unit having an upright tank 32 supported on caster wheels 33 and powered by an electric motor 34.

The motor housing 18 (FIG. 2) is provided with several holes 47 for venting the electric motor supported therein. The lead wires for the motor are directed through the large rear handle 17 and outwardly therefrom within an electric cord 48 which is fastened at one end to a rear portion of the handle 17 by a suitable fitting 49. A trigger switch 51 within the rear handle 17 serves as the on-off switch for the motor. For safety, trigger switch 51 is provided as a dead man switch with the motor having a two second shut off capability.

The motor is connected through a gear reduction unit 52, FIG. 2, to the drive shaft 15 extended downwardly from the gear reduction unit toward the opening 24 in the base structure top wall 19. A cylindrical collar 54 is fixed onto the shaft 15 below the transmission housing 52, the lower end 56 of said collar 54 adapted for engagement with the upper surface of the wire brush 25.

The portable base structure 12 is movably supported on thin annular disk shaped front wheels 35 and rear wheels 36 (FIG. 3), which are fixed on respective front and rear cylindrical hub portions 37 and 38 rotatably mounted on associated shafts 39. Each shaft 39 is comprised of a bolt insertable through a corresponding bore 41 in the base structure side wall 22 or 23, for threaded engagement within a tapped bore 42 formed in one of the longitudinally extended gusset members 43 extended between the annular flange 27 and the front and rear walls 20 and 21, respectively of the base structure.

The bores 41 for the shafts or bolts 39 are formed in inwardly recessed flat portions 44, FIG. 1, of the base structure side walls 22 and 23 so that the bolt heads 46 lie within the lateral confines of the base structure 12. Thus, with one side wall 22 or 23 of the base structure engaged directly against a wall surface, the bolt heads 46 on that side wall are disposed in a clearance relation with the wall surface.

The front wheels 35 are arranged at the outer ends of their respective hub portions 37, whereas the rear wheels 36 are disposed at the inner ends of their respective hub portions 38 so that the rear wheels 36 define paths of movement intermediate the paths of the front wheels 35 for a purpose to be later described. The front wheels 35 are spaced apart by a distance greater than the radius but less than the diameter of the working surface of wire brush 25 to assure the shredding and removal of the entire strip of material between the paths of movement of the front wheels.

Figure 3:
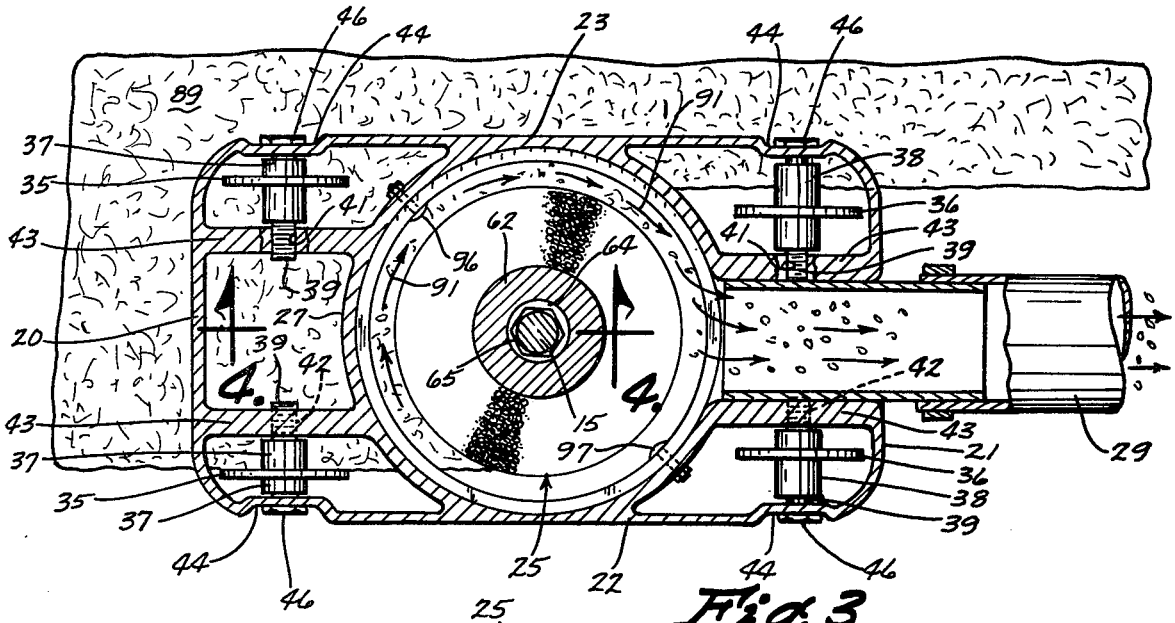
FIG. 3 is a sectional view of the base structure, taken on line 3—3 in FIG. 2.
Figure 4:
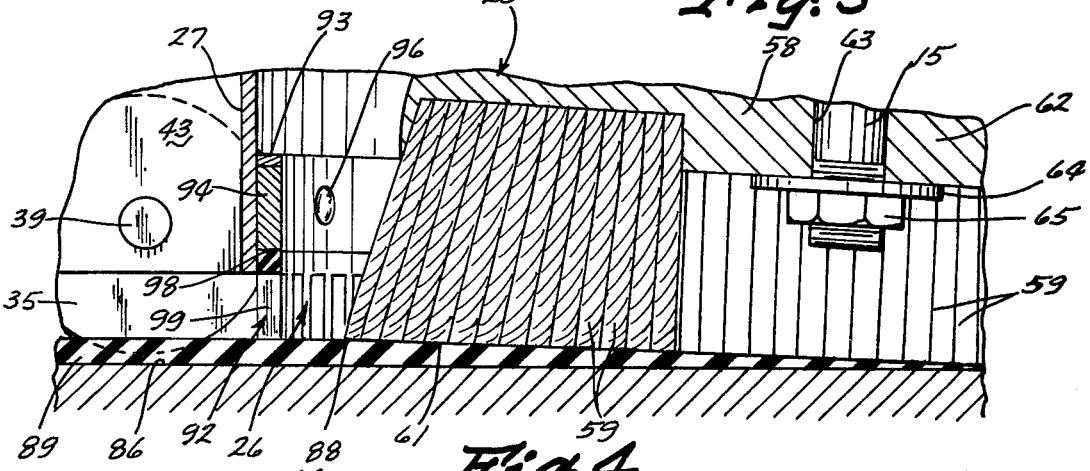
FIG. 4 is an enlarged detail sectional view taken on line 4—4 in FIG. 3 showing the inclination of the working surface of the steel brush with the floor covering.
Figure 5:
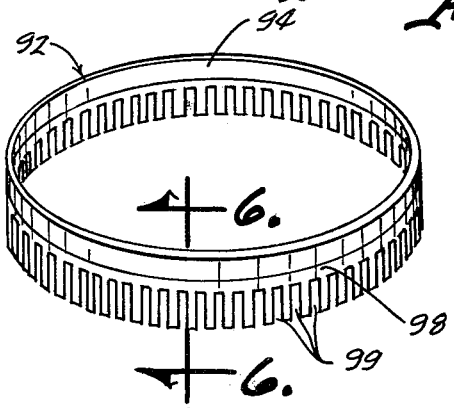
FIG. 5 is a reduced perspective view of the flexible skirt which confines the removed material within the shredding chamber for discharge from the machine.
Figure 6:
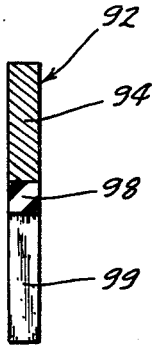
FIG. 6 is an enlarged detail sectional view of the skirt member, taken on line 6—6 in FIG. 5.

The wire brush 25 has an inverted cup-shaped body 58 from which a plurality of carbon steel wires 59 extend downwardly for termination at their lower ends in a generally flat working surface 61. Referring to FIGS. 3 and 4, the body 58 includes a center hub portion 62 having a center bore 63 for receiving the threaded lower end of the drive shaft 15. A washer 64 and retaining nut 65 secure the wire brush 25 onto the drive shaft 15 against the lower end 56 of the collar 54 for rotation therewith in driven relation with the electric motor of the machine 10.

To support the upper frame 13 relative to the portable base structure 12, a universal tilting mechanism 66, FIGS. 1 and 2, is provided including three upstanding threaded posts 67, 68 and 69, the lower ends of which are threaded into and supported by respective bosses 71, 72 and 73 on the base structure top wall 19. The posts 67 and 68 are arranged at the forward corners of the base structure, with the remaining post 69 situated adjacent the rear wall 21 centrally of the base structure 12.

The mounting plate 14 on the upper frame 13 is provided with three corresponding holes for receiving the upper ends of the posts 67, 68 and 69. Heavy compression springs 77, 78 and 79, FIGS. 1 and 2, are mounted about the posts 67, 68 and 69, respectively, in compression between the bosses 71, 72 and 73 and the mounting plate 14. Nuts 81, 82 and 83 for the respective posts 67, 68 and 69 are located in bearing engagement with mounting plate 14 to adjust the vertical and inclined position of the upper frame 13 relative to the floor surface 86.

The substantial force exerted by each compression spring through the mounting plate 14 against its respective nut serves to lock the nut in its adjusted position without the requirement of an additional locking nut. It is seen, therefore, that the compression springs enable a fine adjustment of the upper frame relative to the base structure 12 within the vertical range of compression of the springs. The springs are heavy enough that they are not further compressed or expanded by normal operation of the machine, but rather only by adjustment of the nuts 81, 82 and 83.

It can be seen that by adjusting the upper frame 13 relative to one or more of the posts 67, 68 and 69, the drive shaft 15 may be inclined in any desired direction relative to a vertical axis position therefor and the upper frame 13 may be raised and lowered to accomodate for cutting action and brush wear.

In operation, the greater portion of a floor surface is stripped by advancing the machine across the floor surface with the vacuum unit 11 in a trailing relation behind the machine 10. For this operation the nuts 81, 82 and 83 are adjusted to incline the drive shaft 15 downwardly and forwardly by an angle indicated at 84 in FIG. 2. Consequently, the generally flat working surface 61 of the wire brush 25 is inclined upwardly and forwardly from the floor surface by the same angle 84 with a rear portion 87 thereof in contact engagement with the floor surface 86.

Referring to FIG. 4, the angle of inclination for the wire brush 25 is selected so that a forward end portion 88 of the working surface 61 is situated above the floor surface 86 by a distance substantially equal to the thickness of the covering material 89 to be removed. Thus, in response to a forward movement of the machine 10 along the floor surface 86, the covering material 89 is progressively removed by the inclined working surface 61 of the brush 25. With the wire brush 25 rotated in the direction of arrows 91 in FIG. 3, the removed material is orbited within the shredding chamber 26 for discharge through opening 28 to and through the vacuum suction hose 29.

To prevent the shredded material from being thrown outwardly of shredding chamber 26, a flexible skirt 92 (FIG. 4) is fitted within the depending flange 27 of the shredding chamber 26 against a horizontal inner annular flange 93. The skirt 92 includes an annular metal band 94, which is secured to the flange 27 by a pair of bolts 96 and 97 (FIG. 3), and a depending rubber skirt 98 fused to the bottom of the annular band 94 and having a plurality of circumferentially spaced vertical slots or openings 99. The flexible skirt portion 98 is easily folded back as the machine is advanced into uncut covering material 89. Furthermore, air freely enters the slots 99 to enable the vacuum unit 11 to draw the shredded material through the discharge opening 28.

The thin disk shaped wheels 35 and 36 easily penetrate uncut material, as shown in FIGS. 3 and 4, substantially to the level of the floor surface so that the base structure 12 advances smoothly along a generally flat line of travel regardless of irregularities in the covering material 89 to be removed. On a first run through the material, both front wheels 35 travel through the uncut material whereas on subsequent runs, one of the front wheels may be guided along the floor surface adjacent to the edge of the material to be removed so that only a single forward wheel 35 travels on and penetrates such material. The rear wheels 36 thus normally traverse the cleared floor surface 86 to maintain the selected inclination of brush working surface 61 with the floor surface 86.

For the removal of material along a wall, the upper frame 13 may be readjusted to incline the working surface 61 laterally of the base structure 12 so that the side of the working surface 61 nearest to the wall is in contact engagement with the floor surface 86 and the side away from the wall is elevated above the surface by a distance substantially equal to the thickness of the material 89 to be cut. This may be accomplished by raising the upper frame 13 on one forward post 67 or 68 to the same extent that it is lowered on the opposite forward post 67 or 68 relative to the connection to the rear post 69. The universal tilting mechanism 66 enables the wire brush 25 to be tilted to a limited extent in any desired direction.

The inclination of the working surface 61 of the wire brush 25 relative to the floor surface 86 prevents the walking or racing effect commonly experienced with floor scrubbers wherein a rotary scrubbing element is engaged flush against the floor surface.

Although the invention has been described with respect to a preferred embodiment thereof, it is to be understood that it is not to be so limited since changes and modifications can be made therein which are within the full intended scope of this invention as defined by the appended claims.

I claim:

1. A machine for shredding and removing covering material from a floor surface, comprising:

(a) a portable base structure including an open bottomed shredding chamber having a discharge opening, (b) an upper frame structure, (c) means for adjustably supporting the upper frame on the portable base structure, said support means being adjustable to vary both the height and inclination of the upper frame relative to the portable base structure, (d) wire brush means, rotatable within the shredding chamber having a working surface adjacent the floor surface for engaging and shredding covering material on the floor surface, (e) means for supporting said wire brush means on the upper frame for rotation about an upright axis inclined relative to the floor surface, and (f) a motor supported on said upper frame and connected in a drive relation with said wire brush means, whereby material shredded by the rotating brush means is orbited within the shredding chamber toward the discharge opening.

2. A machine for shredding and removing covering material, according to claim 1, including:

(a) vacuum means associated with the discharge opening for drawing shredded material therethrough.

3. A machine for shredding and removing covering material, according to claim 1, wherein:

(a) said covering material includes a layer of resilient material and means for adhering said layer to the floor surface, (b) said portable base structure includes a plurality of support wheels adapted to carry the portable base structure in a spaced relation with the floor surface, and (c) at least one of said support wheels comprising a thin rigid disk adapted for penetrating said floor covering material substantially to the level of the floor surface.

4. A machine for shredding and removing covering material, according to claim 1, including:

(a) a flexible skirt member supported in a concentric relation within said shredding chamber and positioned below the discharge opening and in sweeping relation with the floor surface, said skirt member having a plurality of openings.

5. A machine for shredding and removing covering material, according to claim 1, wherein:

(a) said wire brush means includes a cluster of downwardly projecting wires terminating at the lower ends thereof in a generally flat working surface, and (b) said working surface being inclined relative to the floor surface such that one peripheral portion thereof engages the floor surface and a diametrically opposite peripheral portion thereof is disposed above the floor surface by a distance generally equal to the thickness of the covering material to be removed.

6. A machine for shredding and removing covering material from a floor surface, according to claim 1, wherein:

(a) said adjustable support means includes a plurality of upright posts supported on the base structure in spaced apart relation, and means for connecting said upper frame to each of said posts, said connecting means being independently vertically adjustable with respect to each post.

7. A machine for shredding and removing covering material from a floor surface, according to claim 6, wherein:

(a) said connecting means includes spring means arranged in compression between said upper frame and portable base structure, whereby the connection of the upper frame to each upright post is vertically adjustable within the range of compression of said spring means.

8. A machine for stripping covering material from a surface, comprising:

(a) a portable base structure including an open bottomed shredding chamber having a discharge opening, (b) a motor unit adjustably supported above said base structure, said motor unit including an output shaft extended downwardly toward said base structure, (c) wire brush means having a generally flat working surface, said wire brush means connected in a driven relation with said output shaft for rotation of the working surface thereof within the shredding chamber adjacent the surface to engage and shred covering material on the surface, and (d) means for adjusting the height and inclination of said motor unit relative to said base structure.

9. A machine for stripping covering material according to claim 8, wherein:

(a) said portable base structure includes front and rear support wheels, said front wheels including a pair of thin disk shaped wheels spaced transversely apart by a distance greater than the radius and less than the diameter of said working surface, each rear wheel situated rearwardly of and transversely intermediate said pair of disk shaped wheels.

10. A machine for stripping covering material, according to claim 8, wherein:

(a) said motor unit is adjustable relative to the base structure for rotation of said working surface about an upright axis inclined relative to said surface.

* * * * *